US007188009B2

(12) United States Patent
Hawthorne

(10) Patent No.: US 7,188,009 B2
(45) Date of Patent: Mar. 6, 2007

(54) CHAIN OF CUSTODY

(75) Inventor: Michael J. Hawthorne, Arlington, TX (US)

(73) Assignee: New York Air Brake Corporation, Watertown, NY (US)

( * ) Notice: Subject to any disclaimer, the term of this patent is extended or adjusted under 35 U.S.C. 154(b) by 480 days.

(21) Appl. No.: 10/491,405

(22) PCT Filed: Oct. 30, 2002

(86) PCT No.: PCT/US02/34693

§ 371 (c)(1),
(2), (4) Date: Mar. 30, 2004

(87) PCT Pub. No.: WO03/037694

PCT Pub. Date: May 8, 2003

(65) Prior Publication Data

US 2004/0215376 A1 Oct. 28, 2004

(51) Int. Cl.

| | |
|---|---|
| ***G05D 1/00*** | (2006.01) |
| ***G06F 17/00*** | (2006.01) |
| ***G06F 17/10*** | (2006.01) |
| ***B61C 11/00*** | (2006.01) |

(52) U.S. Cl. ..... 701/19; 246/15; 246/167 R

(58) Field of Classification Search ..... 701/19, 701/29, 20, 56, 202, 206

See application file for complete search history.

(56) References Cited

U.S. PATENT DOCUMENTS

| | | | | |
|---|---|---|---|---|
| 4,042,810 | A * | 8/1977 | Mosher | 701/19 |
| 4,072,850 | A * | 2/1978 | McGlynn | 701/35 |
| 4,181,943 | A * | 1/1980 | Mercer et al. | 701/20 |
| 4,241,403 | A * | 12/1980 | Schultz | 701/35 |
| 4,752,899 | A * | 6/1988 | Newman et al. | 702/188 |
| 4,794,548 | A * | 12/1988 | Lynch et al. | 702/188 |
| 5,053,964 | A * | 10/1991 | Mister et al. | 701/19 |
| 5,124,920 | A * | 6/1992 | Tamada et al. | 701/36 |
| 5,289,369 | A * | 2/1994 | Hirshberg | 705/13 |
| 5,428,546 | A * | 6/1995 | Shah et al. | 701/207 |
| 5,444,842 | A * | 8/1995 | Bentson et al. | 715/854 |
| 5,744,707 | A * | 4/1998 | Kull | 73/121 |
| 5,758,299 | A * | 5/1998 | Sandborg et al. | 701/29 |
| 5,826,206 | A * | 10/1998 | Nemeth | 701/35 |
| 5,862,048 | A * | 1/1999 | Knight | 700/9 |
| 6,182,047 | B1 * | 1/2001 | Dirbas | 705/3 |
| 6,430,488 | B1 * | 8/2002 | Goldman et al. | 701/36 |

FOREIGN PATENT DOCUMENTS

| | | |
|---|---|---|
| GB | 2 188 464 A | 9/1987 |
| WO | WO 01/33513 A | 5/2001 |

* cited by examiner

*Primary Examiner*—Thomas Black
*Assistant Examiner*—Wae Lenny Louie
(74) *Attorney, Agent, or Firm*—Barnes & Thornburg LLP

(57) ABSTRACT

A method of controlling a train for a crew change and includes collecting information on the train including weight and length of the train, special weight distribution, number and location of cars with cut-out or inoperative brakes, status of dynamic brakes on all locomotives, if brake test is required, and prior train brake problems. The information is stored as a report and displayed at a crew change. The train is disabled until the crew has accepted the report.

22 Claims, 2 Drawing Sheets

CHAIN OF CUSTODY

BACKGROUND AND SUMMARY OF THE INVENTION

The present invention relates generally to control of locomotives and trains and more specifically to the transfer and control of trains at a crew change.

The Federal Railroad Administration of the United States Department of Transportation has modified their regulations with respect to dynamic brake requirements and the communication of train handling information for non-passenger trains. The modification of 48 CFR 232.109 entitled Dynamic Brake Requirements and 232.111 entitled Train Handling Information having an effective date of Apr. 1, 2001.

With respect to the dynamic brake requirements of Section 232.109, all new locomotives are to be equipped with dynamic brakes and have the ability to test the electrical integrity of the dynamic brakes at rest. It should also display the availability of total dynamic brake retarding force at various speed increments or the train deceleration rate in the cab of the controlling (lead) locomotive. It also includes a "mile-per-hour-overspeed-stop" rule. A train shall be brought to a stop if it exceeds the authorized speed by five miles per hour when descending a grade of one percent or greater.

The train handling information that must be provided under Section 232.111 to a train crew upon taking responsibility of the train includes:

1. A total weight and length of the train;
2. Any special weight distribution that would require special train handling procedures;
3. The number and location of cars with cut-out or otherwise inoperative brakes and location where they will be repaired;
4. If the Class I or Class IA brake test is required prior to the next crew change point and the location at which the test should be performed; and
5. Any train brake problems encountered by the previous crew of the train.

The means or method of providing the information is not specified; however, a written or electronic record of the information shall be maintained in the cab of the controlling locomotive.

The present invention is a method of controlling a train for a crew change and includes collecting information on the train including weight and length of the train, special weight distribution, number and location of cars with cut-out or inoperative brakes, status of dynamic brakes on all locomotives, if brake test is required, and prior train brake problems. The information is stored as a report and displayed at a crew change. The train is disabled until the crew has accepted the report.

The information is collected during a previous run, and the report is prepared and stored at the conclusion of the previous run. The report includes one or more the conditions of dynamic brake efficiency, inoperative dynamic brake systems, train consist, air brake efficiency, number of reported inoperative air brake systems, propulsion system efficiency, pre-departure analysis of run and results of pre-departure test.

The method includes requesting release of the train by a previous crew and disabling the train upon crew release. The identification of the accepting and the prior crew can be stored with the report. The identification may include the qualification level of the crew. The qualification level is compared to a required level to operate the train, and the train is enabled if the qualification level meets the required level. The acceptance and identification is an electronic signature.

The method includes determining the location of the train and determining and displaying the location of the nearest repair facility along a present run. Also, the location of the next crew change along the present run may be determined and displayed.

The information includes time and date of an indication that a dynamic brake had failed or that a car brake is cutout or inoperative; and including determining if an unacceptable amount of time has passed since the indication, and displaying the determination once made. The determination may be displayed as part of the report. The display may include a representation of the train with indicia of brake status of the locomotive and cars. Also, the method may include determining if an unacceptable operating condition for the train exists, as defined by preset standards, and displaying the determination as part of the report. The determination may be displayed once it is determined.

The method may included analyzing the collected information with a topology of a run, determining if the train is safe for operation over the run and displaying the determination. The determination may be displayed as part of the report. The collecting of information, analyzing, determining and displaying is performed periodically during the run. The analyzing includes determining margins for operating parameters and displaying the margins.

The method may include determining the location of the train with respect to topology of a run, analyzing the collected information with the topology of the run, determining if the train will exceed the preset speed limits ahead in the run based on the present information and displaying the determination. The method may also include determining if the train will exceed the preset speed limits ahead in the run based on the present information no matter how much braking occurs and displaying the determination.

These and other aspects of the present invention will become apparent from the following detailed description of the invention, when considered in conjunction with accompanying drawings.

DETAILED DESCRIPTION OF THE PREFERRED EMBODIMENTS

Figure 2:
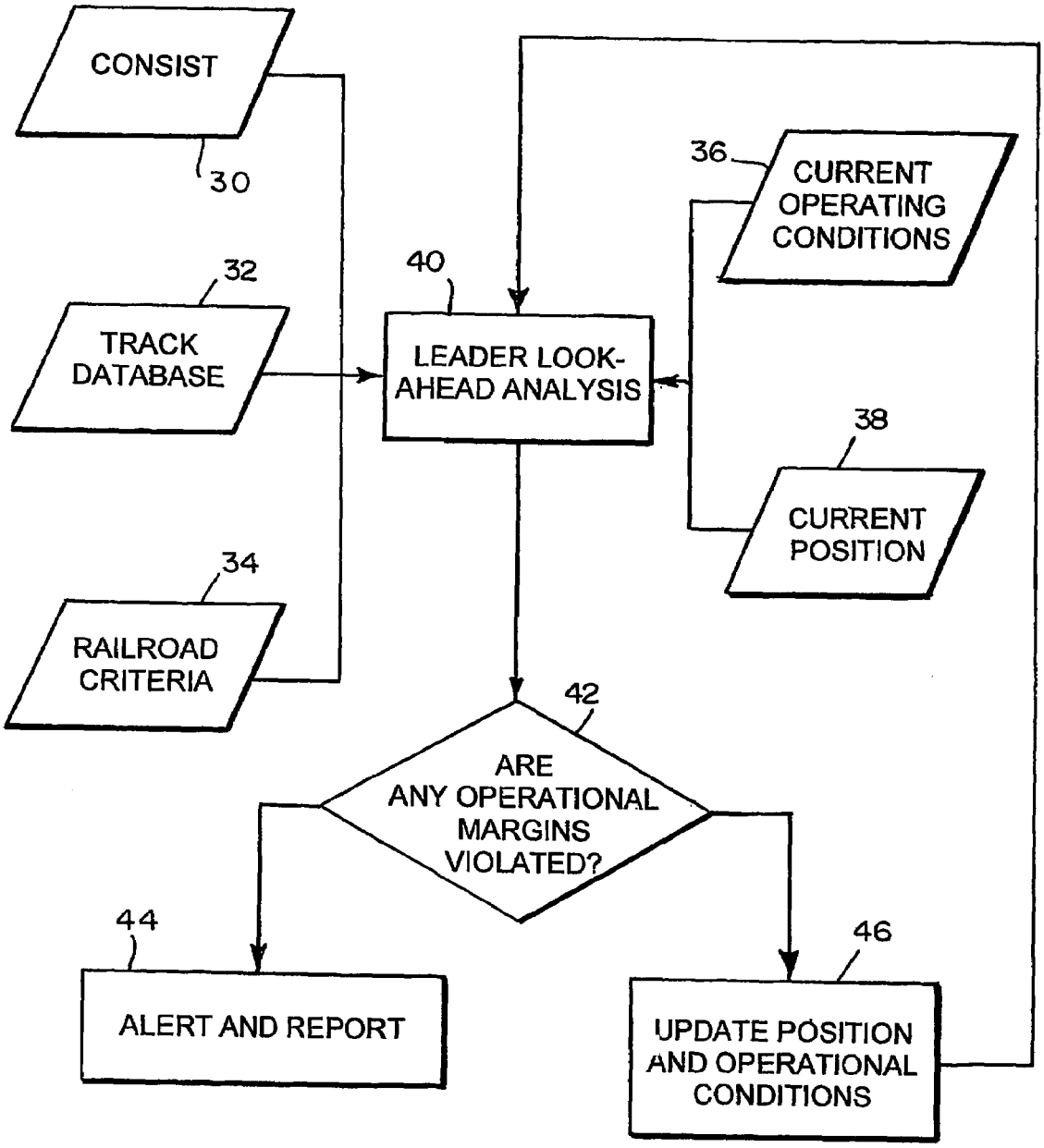
FIG. 2 is a flow chart of a method of determining speed limit violations according to the principles of the present invention.

A LEADER System, available from New York Air Brake of Watertown, N.Y. and as described in U.S. Pat. No. 6,144,901, incorporated herein by reference, communicates from the controlling locomotive to the trailing and remote locomotives to monitor and report the condition of all locomotives in the train and provide appropriate commands, as illustrated in FIG. 2 thereof. The display of FIG. 5 thereof shows the location of the cars and locomotives throughout the train, the in-train forces as generated by the propulsion, dynamic brake, air brake and geography of the occupied territory, and consist length. In the driver assist mode, the LEADER System provides information such as the optimum locomotive dynamic brake and throttle settings as well as the automatic air brake settings to meet a railroad defined criteria. See the top of Column 8. The LEADER System also measures propulsion and dynamic brake efforts as well as pneumatic brake settings at each locomotive. It has the ability to communicate this information to and from each of the locomotives in the train and create a display that allows the operator a complete view to train dynamics. Locomotive propulsion and dynamic brake forces are shown for individual locomotives in the train and as composite values for the entire train. The values are shown numerically and graphically and are continually updated in real-time.

The present invention makes use of the LEADER System or equivalent systems and its capabilities to collect information on the status of the cars and the locomotives and makes use of the LEADER System to store the information required by 48 CFR 232.111 or similar regulations. The LEADER System determines the efficiency of the dynamic brake and records the value as the train is moved across the territory. Thus, the LEADER System can provide a history of dynamic brake use as well as consist information including location, weight, and length of the cars, the weight and length of the train and the number and location of the cut-out or otherwise inoperative brakes, either dynamic onboard a locomotive(s) or air brake onboard a car(s).

Figure 1:
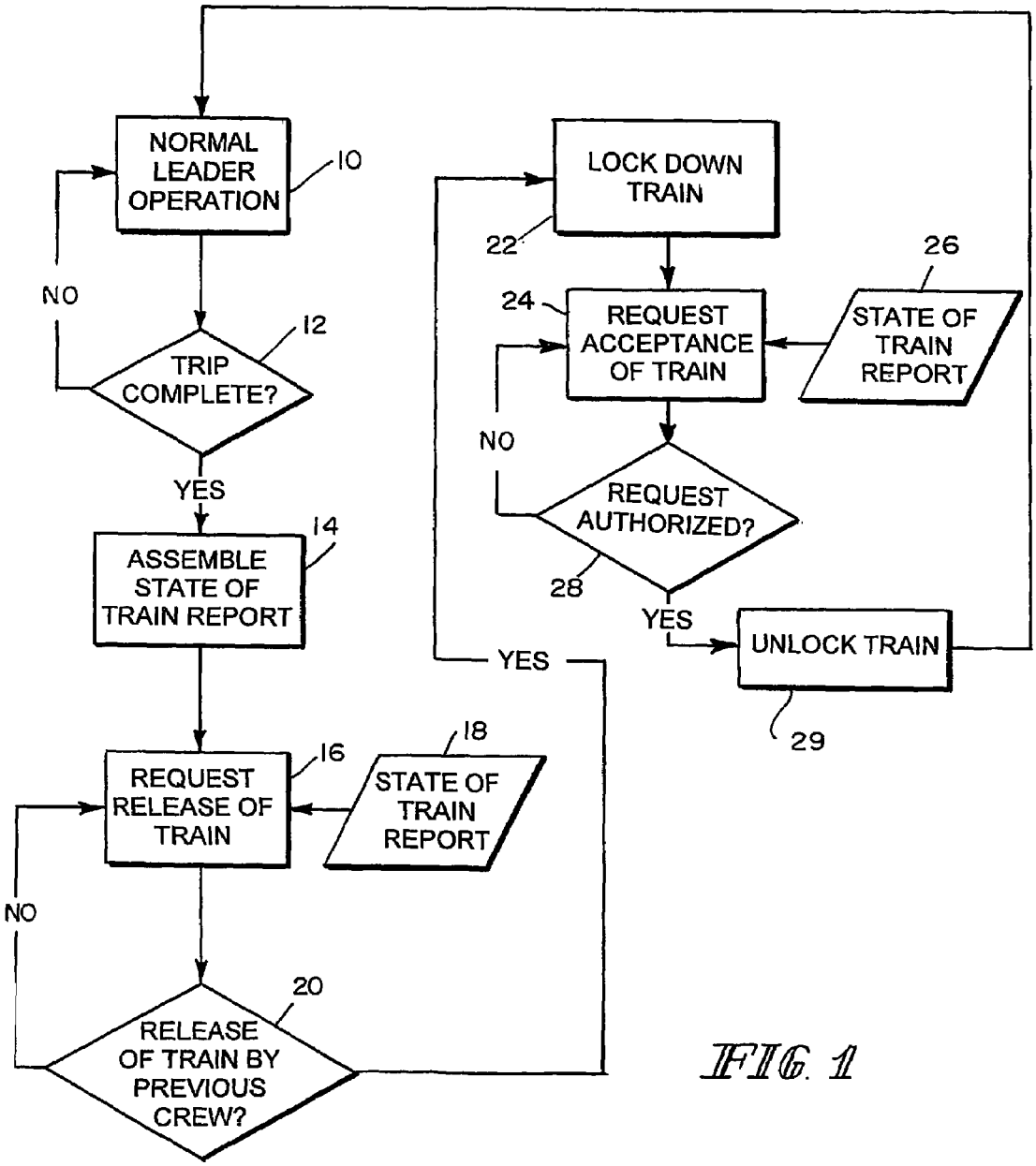
FIG. 1 is a flow chart of a method for establishing a chain of custody at crew change according to the principles of the present invention.

FIG. 1 shows a flow chart of the method of the present invention to ensure the cognizant passing of responsibility of one train crew to the next including the passing of all pertinent information about the train. In this "chain of custody" method, the release and acceptance of the train by successive crews can be done electronically on board the LEADER Display. The electronic signatures of the crews will be recorded as part of the logfile set and can be transmitted off-board to a base station network and reported (as desired by the railroad) as all other LEADER events. The individuals in the electronic exchange would require proper levels of clearance to take control of the train. By accepting the train, the new crew would be acknowledging the condition of the train summarized in a "State of the Train" with respect to:

Dynamic Brake Efficiency (Performance)

Inoperative Dynamic Brake Systems

Train Consist (Length and Weight of the Train)

Air Brake Efficiency (performance)

Number of reported inoperative Air Brake Systems in the train

Propulsion System Efficiency (Performance)

Pre-departure analysis of run (operating margins)

Results of required pre-departure tests (both past and present)

Referring to FIG. 1, as the train progresses along its previous run, the on-board system illustrated as a LEADER System performs its normal operation at 10. This includes collecting information about the train, its status and its operation. Next, there is a determination at 12 on whether the trip is completed. If not, the system cycles back to the normal LEADER operation at 10. If the trip is completed, then a State of the Train Report is assembled at 14. Once the report has been assembled at 14, it is displayed at 18, and a request for releasing the train is performed at 16. A determination is made at 20 on whether the train has been released by the previous crew. If not, it cycles back to further request release of the train at 16. If the crew released the train, it then progresses to lock down or disable the train at 22. Once the train has been locked down, there is a request for acceptance of the train at 24 for the new crew. This includes displaying the State of the Train Report at 26. A determination is made at 28 of whether the request has been authorized. If not, the request at 24 and the display of the report at 26 are repeated. If the request has been authorized, the train is unlocked at 29. The system then begins back at 10 with a normal operation of the train and the LEADER System to collect new data.

Because the LEADER System stores the track in a database and determines location of the train on the track in real-time, it can be updated to include the information on where repair locations are along the route. Thus, the present invention would notify the engineer of the location of the nearest repair point, whether it is for inoperative brakes or for the Class I or Class IA brake test. It also provides an indication of crew change points.

The present invention would not only display and record the information but would also record an acceptance by the crew that they have read and accepted the train and the condition it is in. Also, the railroads have the ability to set limits on what is an acceptable operating condition for the train at each specific crew change point and display whether the acceptable limits have been exceeded. After acceptance, the LEADER System is programmed to continue to display this information such that if unacceptable conditions or changes have occurred, the operator engineer is immediately notified. If the system determines the train does not meet railroad defined criteria or the new crew refuses to accept the train as is, the LEADER System can effectively keep the train locked down and notify the proper personnel as to the cause of the lock down.

The present system can also indicate when the dynamic brakes were indicated to have failed or when the car brakes are reported to be cutout or inoperative. A report can then be run to determine whether the acceptable time for having a repair completed has occurred. This could also be displayed upon crew changes and acknowledged.

The present system is able to retain and display a copy of the most recent regulations with various levels of detail to step the operator through required tests. It will also record the execution of the tests and record the results in the logfiles to produce an electronic record of the event. It will update the onboard database to reflect the most recent changes in regulations much like a software release as described in U.S. patent application Ser. No. 09/404,826 filed Sep. 24, 1999.

The LEADER Screen can be used to electronically tag the locomotive to display malfunctioning or inoperative systems including dynamic and air brake. The LEADER Display will flash/beep a warning to the crew that a malfunction has been detected. The malfunction will be recorded in the logfile set and will remain enforce until a mechanic/electrician with the proper credentials (as determined by his/her ID code) determines the systems to be operational. All postings and clearings of warnings will be recorded in the logfile set with a record of who was responsible for the train at the time of the event.

The present system can, at the point of departure and with a knowledge of the current operational state of the propulsion, dynamic brake and air brake system, perform look-ahead simulations to determine if the train is safe to move per railroad criteria and report on operating margins. The simulations take into account all LEADER dynamic considerations especially geography or topology of the run and determine operational margins. Operating margins are estimates of headroom that describe how well the train can be controlled throughout the planned movement, run or trip. These could include how well the train is expected to behave with respect to such operating parameters as stall speed, how close does the train comes to using full brake effort to avoid over-speed, time to destination, fuel usage, and maximum forces as compared to defined limits. All estimates are done using the immediate historical performance of the train. The same report will be continually updated throughout the trip based on the most recent operating conditions, and the operator will be alerted if any problems are predicted. A pre-departure analysis puts the starting point of this analysis at the crew change point and the operating conditions as the most recent historical data. A running analysis puts the starting point at the current train location while in transit and the operating conditions as the most recent active values.

This process is illustrated specifically in FIG. 2. The information with respect to the consist at 30, the track database including track profile and topologies at 32 and the railroad criteria at 34 are provided to the LEADER Look-Ahead Analysis algorithm 40. Also, the current operating conditions at 36 and the current position at 38 are provided to the LEADER Look-Ahead Analysis 40. The results of the analysis and comparisons are determined. This includes a violation in margins. Next, at 42, it is determined whether any of the operational margins are violated. If they are, an alert and report are generated at 44 and displayed. Also, the position and operational conditions are updated at 46 by the Look-Ahead Analysis algorithm 40.

With respect to a "mile-per-hour-over-speed-stop" rule, the enforcement must be done automatically when 5 mph over the posted speed limit is achieved. To do this properly, the system needs to know what the current speed limit is for the occupied territory and the grade. LEADER, of course, has this capability by comparing set databases of speed restrictions to current location via GPS and other positioning systems. To take this one step further, LEADER can look-ahead, via simulation, and determine that, under current operating conditions, the train is either in no danger for a distance ahead or can begin to warn the crew of pending problems and eventually stop the train if pending danger is detected.

Given the train characteristics including air brake efficiency, train consist (weight and length) and the geography or topology of the run, LEADER can determine the predicted air brake performance in controlling the train's movement. It can also alert the operator if the current situation is deteriorating toward loss of control.

Although the present invention has been described and illustrated in detail, it is to be clearly understood that this is done by way of illustration and example only and is not to be taken by way of limitation. The scope of the present invention are to be limited only by the terms of the appended claims.

What is claimed:

1. A method of controlling a train for a crew change comprising:

collecting information on the train including weight and length of the train, special weight distribution, number and location of cars with cut-out or inoperative brakes, status of dynamic brakes on all locomotives, if brake test is required, and prior train brake problems;

storing the information as a report;

displaying the report at a crew change; and disabling the train until the crew has accepted the report.

2. The method according to claim 1, wherein the information is collected during a previous run, and the report is prepared and stored at the conclusion of the previous run.

3. The method according to claim 1, including requesting release of the train by a previous crew and disabling the train upon crew release.

4. The method according to claim 1, wherein the report includes one or more the conditions of dynamic brake efficiency, inoperative dynamic brake systems, train consist, air brake efficiency, number of reported inoperative air brake systems, propulsion system efficiency, pre-departure analysis of run and results of pre-departure test.

5. The method according to claim 1, including storing the identification of the accepting crew with the report.

6. The method according to claim 5, including storing the identification of the prior crew with the report.

7. The method according to claim 5, wherein the identification includes the qualification level of the crew; and including comparing the qualification level to a required level to operate the train, and enabling the train if the qualification level meets the required level.

8. The method according to claim 5, wherein the acceptance and identification is an electronic signature.

9. The method according to claim 1, including determining the location of the train and determining and displaying the location of the nearest repair facility along a present run.

10. The method according to claim 9, including determining and displaying the location of the next crew change along the present run.

11. The method according to claim 1, wherein the information includes time and date of an indication that a dynamic brake had failed or that a car brake is cutout or inoperative; and including determining if an unacceptable amount of time has passed since the indication, and displaying the determination once made.

12. The method according to claim 11, including displaying the determination as part of the report.

13. The method according to claim 1, including determining if an unacceptable operating condition for the train exists, as defined by preset standards, and displaying the determination as part of the report.

14. The method according to claim 13, including displaying the determination once it is determined.

15. The method according to claim 1, including analyzing the collected information with a topology of a run, determining if the train is safe for operation over the run and displaying the determination.

16. The method according to claim 15, including displaying the determination as part of the report.

17. The method according to claim 15, wherein the collecting information, analyzing, determining and displaying is performed periodically during the run.

18. The method according to claim 15, wherein the analyzing includes determining margins for operating parameters and displaying the margins.

19. The method according to claim 1, wherein the display includes a representation of the train with indicia of brake status of the locomotive and cars.

20. The method according to claim 1, determining the location of the train with respect to topology of a run, analyzing the collected information with the topology of the run, determining if the train will exceed the preset speed limits ahead in the run based on the present information and displaying the determination.

21. The method according to claim 20, including determining if the train will exceed the preset speed limits ahead in the run based on the present information no matter how much braking occurs and displaying the determination.

22. The method according to claim 1, downloading the reports from the train.

* * * * *